United States Patent [19]

Woods

[11] Patent Number: 4,752,273

[45] Date of Patent: Jun. 21, 1988

[54] TOY WITH LIGHTABLE EYES

[76] Inventor: Fred B. Woods, 9119 East 34th St., Indianapolis, Ind. 46236

[21] Appl. No.: 887,516

[22] Filed: Jul. 21, 1986

[51] Int. Cl.[4] ..... A63H 3/38

[52] U.S. Cl. ..... 446/392; 446/485

[58] Field of Search ..... 446/392, 485, 337, 341, 446/389, 268, 372; 362/808, 124; 40/442

[56] References Cited

U.S. PATENT DOCUMENTS

| | | | |
|---|---|---|---|
| 1,877,940 | 9/1932 | Morgenstern et al. | 446/485 X |
| 2,370,601 | 2/1945 | Wimpfheimer et al. | 446/485 X |
| 3,808,418 | 4/1974 | Conard et al. | 446/389 X |
| 4,055,014 | 10/1977 | Schmidt et al. | 40/442 |

FOREIGN PATENT DOCUMENTS

| | | | |
|---|---|---|---|
| 2066089 | 7/1981 | United Kingdom | 446/392 |

*Primary Examiner*—Mickey Yu

*Attorney, Agent, or Firm*—Woodard, Emhardt, Naughton, Moriarty & McNett

[57] ABSTRACT

A toy having lightable eyes. A toy configured as a doll or other animal having a pair of eyes includes two flashlight bulbs mounted within pupil passages in the eyes. The passages are restricted to prevent accidental removal of the bulbs which are connected to a source of electrical energy by an externally operated switch.

8 Claims, 3 Drawing Sheets

TOY WITH LIGHTABLE EYES

BACKGROUND OF THE INVENTION

This invention is in the field of toys, and more specifically those including stuffed animals and dolls. A variety of different types of stuffed animals and dolls are provided for children who, in many cases, will carry the toys during the day and place the toys in bed at night.

Some children have genetically transmitted night blindness providing not only inconvenience to the child, but also creating dangerous conditions. Night blindness prevents a person from having normal vision in a darkened room or in the outside in the evening. Further, even in a subdued lighted environment, a person will not adequately be able to see in order to conveniently and safely walk from location to location. Many persons suffering from night blindness carry a flashlight: however, children may be embarrassed to always carry a flashlight at night or may simply forget to carry the same. On the other hand as previously described, children will frequently carry a toy such as a stuffed animal or doll and thus by incorporating a light into the toy a child is provided with a convenient means to cope with night blindness.

I have designed a stuffed animal or doll with lighting means so as to not be noticeable when the lights are in an off condition. Such has been accomplished by incorporating the lights into the pupils of the eyes of the toy providing a normal toy appearance when the lights are off. A concealed switch connects the light to a battery source thereby allowing the child to conveniently turn the lights on when needed.

A major design consideration in incorporating lights into a toy is the requirement that the lights not be dislodged by the child allowing the child either to swallow the bulbs or perhaps allow the bulbs to break with subsequent injury to the child. Therefore, I have constructed a means for holding the bulbs to prevent the accidental removal of the bulbs while at the same time allowing the bulbs to be interiorly removed in the event the bulbs are inoperable. Further, many toys present on the market include pivoting eyes to simulate eyes which will open and close. I have, therefore, provided a particular structure allowing the incorporation of my invention into toys having pivoting eyes allowing my invention to be incorporated into existing toys as well as new toys.

SUMMARY OF THE INVENTION

One embodiment of the present invention is a stuffed toy comprising an animal shaped main body including a head with a pair of eye sockets having eyes mounted therein, the eyes each having a pupil location, a pair of light bulbs mounted in the eyes with each bulb located centrally within the pupil location and arranged to be externally visible so the bulbs appear to be pupils within the eyes, a battery receptacle mounted within the main body to receive electrical batteries, circuit means connecting the bulbs with the receptacle, and, an externally operable electrical switch mounted to the main body and being electrically positioned in the circuit means between the bulbs and the battery receptacle operable to connect and unconnect the bulbs with the battery receptacle for operation of the bulbs and lighting of the eyes.

A further embodiment of the present invention is a light comprising a main body including a head with a pair of eye sockets having eyes mounted therein, the eyes each having a pupil location, a pair of light bulbs mounted in the eyes with each bulb located within the pupil location and arranged to be externally visible so the bulbs appear to be pupils within the eyes, a battery receptacle mounted within the main body to receive electrical batteries, circuit means connecting the bulbs with the receptacle, and, an electrical switch mounted to the main body and being electrically positioned in the circuit means between the bulbs and the battery receptacle operable to connect and unconnect the bulbs with the battery receptacle for operation of the bulbs and lighting of the eyes.

It is an object of the present invention to provide a new and improved toy.

A further object of the present invention is to provide a toy having a controllable light mounted therein to be used by a child suffering from night blindness.

In addition, it is an object of the present invention to provide a stuffed animal or doll having energizable light bulbs mounted in the pupils of the eyes of the animal or doll.

Related objects and advantages of the present invention will be apparent from the following description.

DESCRIPTION OF THE PREFERRED EMBODIMENTS

Figure 1:
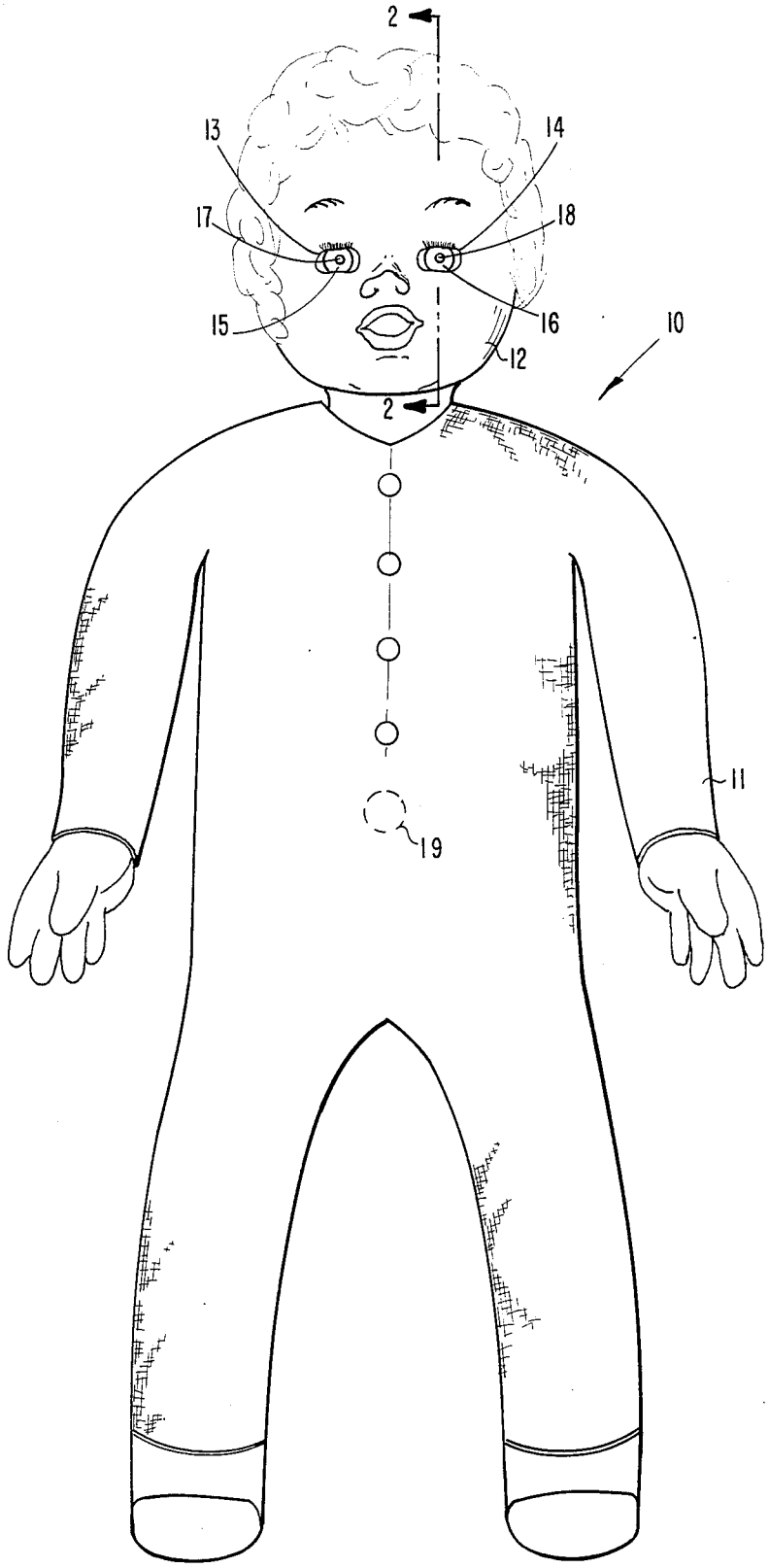
FIG. 1 is a view of a doll incorporation the present invention.

For the purposes of promoting an understanding of the principles of the invention, reference will now be made to the embodiments illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
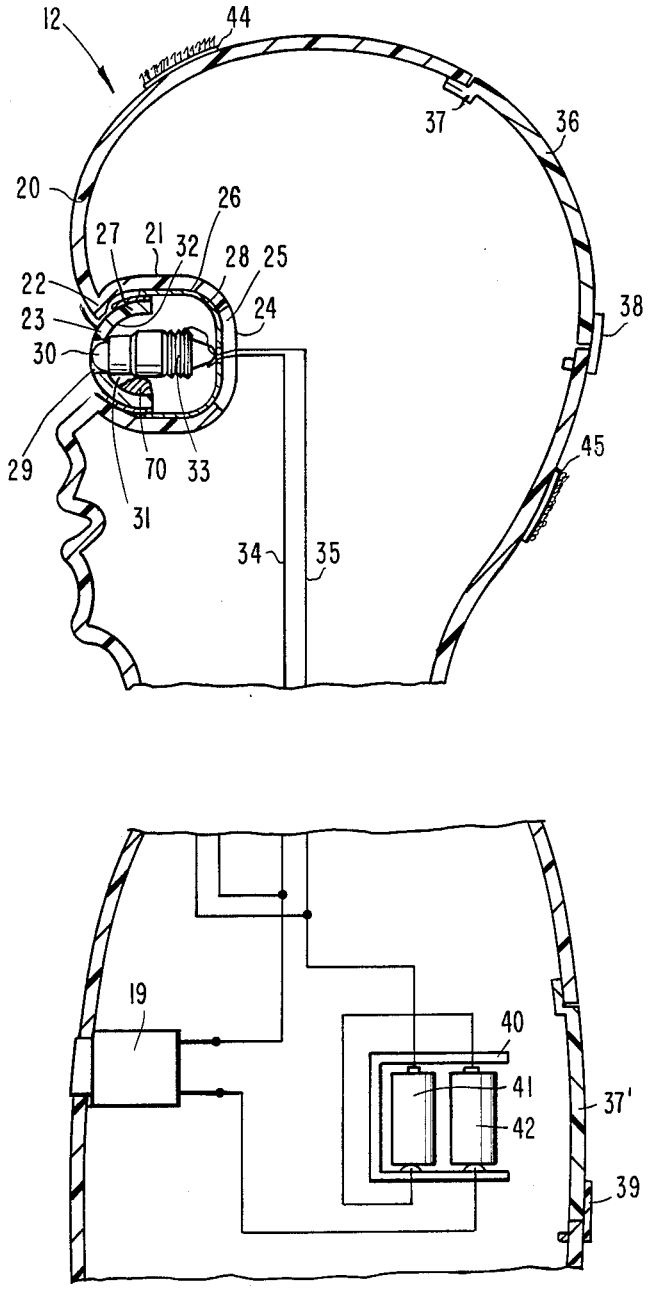
FIG. 2 is a fragmentary enlarged cross-sectional view taken along line 2—2 of FIG. 1 and viewed in the direction of the arrows.
Figure 4:
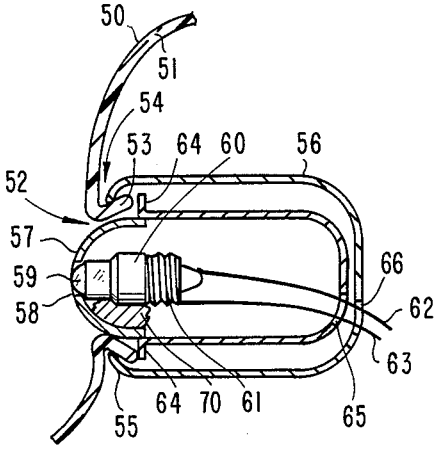
FIG. 4 is a fragment of the same view of FIG. 2 only showing an alternate embodiment of the present invention.

Referring now more particularly to FIGS. 1 and 2, there is shown the preferred embodiment of the stuffed toy 10 incorporating the present invention. Toy 10 includes an animal shaped main body 11 and in the case of FIG. 1 being configured as a doll. The toy main body includes a head 12 with a pair of eye sockets 13 and 14 having eyes 15 and 16, respectively, mounted therein. Eyes 15 and 16 have centrally located pupil locations 17 and 18, respectively. A pair of light bulbs are mounted in the eyes with each bulb located centrally within the pupil locations 17 and 18 and are arranged to be externally visible so that the bulbs appear to be pupils within the eyes. The bulbs are electrically connected via a switch 19 to a battery receptacle mounted within the main body. A suitable number of batteries are mounted within the receptacle thereby allowing the lights to be operated through the operation of switch 19. The present invention may be provided in the form of a kit to be installed in an already existing doll shown in FIGS. 1 and 2, or may be initially built into the doll such as shown in the alternate embodiment of FIG. 4.

Head 12 is produced from a sheet 20 of flexible or resilient material having a pair of concave configurations 21, one of which is shown in FIG. 2, thereby forming the eye sockets. Each concave configuration 21 opens externally and is restricted at location 22 surrounding the external opening thereby preventing the eye main body 23 from moving outwardly through the opening. Commercially available dolls are available having concave configurations 21 which have a closed end 24 thereby also preventing movement of the eyes rearwardly and in cooperation with restriction 22, the removal of the eyes from the sockets. Such commercially available dolls do not have light sources mounted in the eyes. Thus, the present invention includes the step of slitting or cutting end 24 thereby forming a rear opening 25 through which the eyes are removed to facilitate the installation of the light sources within the pupil locations. The sheet of material 20 is sufficiently resilient so that opening 25 is normally closed, but is yieldable to allow removal of the eyes therethrough.

In the prior art dolls, eye main body 23 is pivotally mounted within a metal housing 26 in turn fixedly mounted within concave configuration 21. Metal housing 26 includes a forward cap 27 fixedly mounted to and extending within the rear cap 28 of the housing. Eye main body 23 may be provided with a pair of outwardly extending pins which are pivotally received by cap 27 thereby allowing the eye to vertically pivot simulating blinking of the eye. In the embodiment shown in FIG. 2, the eye main body 23 has a semi-circular configuration.

My invention includes removing housing 26 through slit 25 from the concave configuration and then removing the eye main body 23 from the housing by uncoupling cap 27 from cap 28. A pupil passage 29 is then drilled centrally through the length of eye main body 23 with the passage being sufficiently large to allow a conventional flashlight bulb 30 to be inserted therein. The forward surface of bulb 30 is approximately flush with the forward surface of eye main body 23. The glass portion of the bulb is of reduced diameter as compared to the externally threaded metal male mounting plug 33 of the bulb. Passage 29 is enlarged at aft location 31 providing a shoulder or stop surface 32 against which plug 33 abuts limiting outward movement of the bulb from the eye. The positive and negative terminal portions of the externally threaded plug 33 are then connected or soldered to a pair of wires 34 and 35, in turn connected by a switch 19 to the battery receptacle.

Figure 3:
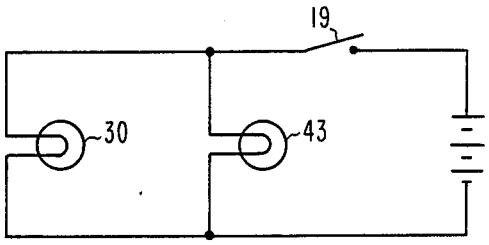
FIG. 3 is a schematic representation of the electrical circuitry for the present invention.

Head 12 includes a removable door 36 mounted to the back portion of the head to allow access to the pair of eyes in case bulbs 30 become inoperative. Door 36 is produced from a sheet of material identical or similar to sheet 20 and is retained in place by an offset end 37 and a pivot latch 38 engageable with the opposite end of the door. In the event one or both bulbs burn out, door 36 is removed and eye main body 23 is pulled rearwardly through slit 25 with either a new eye with bulb inserted or a new bulb being installed in the eye and connected to wires 34 and 35. Likewise, a second door 37′ may be provided in the back portion of the main body of the doll and configured similar to door 36 in that one end of door 37′ has an offset end with the opposite end of the door being engaged by a pivot latch 39. A conventional battery receptacle 40 is mounted in the main body of the doll and is sized to receive a pair of batteries 41 and 42 which are connected in parallel with the pair of bulbs 30 and 43 (FIG. 3) mounted to the pair of eyes. A conventional push button switch 19 is mounted to the forward or stomach section of the doll and is externally accessible to facilitate operation thereof.

Conventional strips of synthetic fastening devices 44 and 45 are fixedly mounted to head 12 and are engageable with mating strips of synthetic fasteners fixedly attached to a wig thereby allowing the wig to be mounted, unmounted and rearranged atop the head while also concealing door 36.

The present invention may also be constructed when the doll is originally produced. Such a doll 50 (FIG. 4) is identical to doll 10 with the exception of the eye socket and eye construction. The head of the doll is produced from a sheet of resilient material 51 and instead of having a pair of concave configurations 21, it is provided with two eye apertures, one of which will now be described, it being understood that an identical description applies to the remaining eye aperture and associated eye construction.

Aperture 52 is formed by a continuous oval or circular curled lip 53 forming an annular recess 54 to removably receive a continuous forward edge 55 of housing 56. Edge 55 is turned inwardly to frictionally engage sheet 50 within recess 54 thereby allowing the housing to be removed for subsequent repair of the eye 57 mounted within housing 56. Eye 57 has a forward surface painted or otherwise marked to appear as an eye with a centrally located pupil passage 58 provided therein to receive the forward portion 59 of a conventional flashlight bulb. The externally threaded male plug portion 61 of bulb 60 is connected by solder or other suitable means to wires 62 and 63 connected to a battery receptacle and a switch in a manner identical to that described for the embodiment shown in FIGS. 2 and 3. Passages 66 and 65 are provided, respectively, in the aft sections of housing 56 and eye 57 to facilitate the routing of wires 62 and 63 to the battery receptacle and switch shown in FIG. 3. A pair of pins or projections 64 extend outwardly from eye 57 past curled edge portion 53 providing a stop and preventing the removal of the eye externally through eye socket 52. Likewise, pupil passage 58 is sufficiently small to prevent passage of the male threaded portion of the bulb thereby preventing movement of the bulb externally through the eye socket. The head is provided with a door identical or similar to door 36 to allow the removal of the housing, eye, and bulb for repair purposes. Likewise, the main body of the doll is provided with a door to allow new batteries to be inserted into the battery receptacle located near the switch 19.

Many variations are contemplated and included in the present invention. For example, the drawings depict the invention as provided within a doll; however, it is understood that an identical invention may be utilized with various toys including stuffed animals such as a cat, dog, bear, etc. In both embodiments, adhesive 70 may be placed between the eye and the bulb to secure the bulb to the eye and further prevent accidental removal thereof. Likewise, in both cases, the eyes have a pupil passage of a diameter at least equal to the diameter of the glass portion of the bulb which in turn is less than the diameter of the male mounting plug of the bulb allowing positioning only of the lightable portion of the bulb in the eye-pupil passage.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A stuffed toy comprising:

an animal shaped main body including a head with a pair of eye sockets having eyes mounted therein, said eyes each having a pupil location:

a pair of light bulbs mounted in said eyes with each bulb located centrally within said pupil location and arranged to be externally visible so said bulbs appear to be pupils within said eyes;

a battery receptacle mounted within said main body to receive electrical batteries;

circuit means connecting said bulbs with said receptacle;

an externally operable electrical switch mounted to said main body and being electrically positioned in said circuit means between said bulbs and said battery receptacle operable to connect and unconnect said bulbs with said battery receptacle for operation of said bulbs and lighting of said eyes; and, bulb mounting means including a pair of resilient material concave configurations forming said sockets, said concave configurations each have an external opening which is restricted limiting movement of said eyes therethrough, said concave configurations further each have an end opposite of said external opening with a normally closed slit therethrough with said eyes with said bulbs movable therethrough to facilitate removal and reinsertion of eyes with new bulbs into said sockets, said bulb mounting means associated with each of said eyes and said bulbs having securing means associated with said bulbs and said eyes being operable to fixedly mount said bulbs to said eyes limiting removal of said bulbs except by removal of said bulbs with said eyes secured thereto, said securing means and said external opening which is restricted preventing removal of said bulbs in a direction extending externally from said sockets.

2. The stuffed toy of claim 1 wherein:

said bulb mounting means further includes a pair of housings removably mounted in said configurations with each housings having mounted therein one of said eyes with bulb; and, said circuit means includes separate wires connected to each bulb with said wires extending out of said housings and through said slit to said receptacle.

3. A stuffed toy comprising:

an animal shaped main body including a head with a pair of eye sockets having eyes mounted therein, said eyes each having a pupil location;

a pair of light bulbs mounted in said eyes with each bulb located centrally within said pupil location and arranged to be externally visible so said bulbs appear to be pupils within said eyes;

a battery receptacle mounted within said main body to receive electrical batteries;

circuit means further includes means, connecting said bulbs with said receptacle;

an externally operable electrical switch mounted to said main body and being electrically positioned in said circuit means between said bulbs and said battery receptacle operable to connect and unconnect said bulbs with said battery receptacle for operation of said bulbs and lighting of said eyes; and, bulb mounting means including a pair of configurations forming said sockets with said configurations removably mounted to said head, said bulb mounting means also includes portilns of said eye sockets also includes portions of said eye sockets forming external openings which are restricted limiting movement of said eyes therethrough, said bulb mounting means further includes means, associated with each of said eyes and said bulbs having securing means associated with said bulbs and said eyes being operable to mount said bulbs to said eyes limiting removal of said bulbs except by removal of said bulbs with said eyes secured thereto, said securing means and said external openings which are restricted preventing removal of said bulbs in a direction extending externally from said sockets, said bulbs have ends opposite of said external openings with terminal means extending outwardly therefrom attached to said circuit means, said bulb mounting means further includes a pair of housings removably mounted in said configurations with each housing having mounted therein one of said eyes with bulb, said circuit means includes separate wires connected to each terminal means.

4. The stuffed toy of claim 3 and further comprising:

a door movably mounted to said head to allow access to said configurations and removal and reinsertion of said eyes with bulbs;

wig removably mounted to said head concealing said door; and, synthetic fastening means mounted to said head and to said wig operable to removably mount said wig to said head.

5. A stuffed toy comprising:

an animal shaped main body including a head with a pair of eye sockets having eyes mounted therein;

a pair of light bulbs mounted in said eyes and arranged to be externally visible;

a battery receptacle mounted within said main body to receive electrical batteries;

circuit means connecting said bulbs with said receptacle;

an externally operable electrical switch mounted to said main body and being electrically positioned in said circuit means between said bulbs and said battery receptacle operable to connect and unconnect said bulbs with said battery receptacle for operation of said bulbs and lighting of said eyes; and, bulb mounting means associated with each of said eyes and said bulbs and having securing means associated with said eyes and said bulbs operable to fixedly mount said bulbs to said eyes limiting removal of said bulbs except by removal of said bulbs with said eyes secured thereto, said bulb mounting means including a pair of resilient material concave configurations forming said sockets, said concave configurations each have an external opening which is restricted limiting movement of said eyes therethrough and with said securing means preventing removal of said bulbs in a direction extending externally from said sockets, said concave configurations further each have an end with passage means opposite of said external opening with said bulbs with eyes movable through said passage means to facilitate removal and reinsertion of eyes with new bulbs into said sockets.

6. The stuffed toy of claim 5 wherein:

said bulb mounting means further includes a pair of housings removably mounted in said configurations with each housings having mounted therein one of said eyes with bulb; and, said circuit means includes separate wires connected to each bulb with said wires extending out of said housings and to said receptacle.

7. A stuffed toy comprising:

an animal shaped main body including a head with a pair of eye sockets having eyes mounted therein;

a pair of light bulbs mounted in said eyes and arranged to be externally visible;

a battery receptacle mounted within said main body to receive electrical batteries;

circuit means connecting said bulbs with said receptacle;

an externally operable electrical switch mounted to said main body and being electrically positioned in said circuit means and connected to said bulbs and said battery receptacle operable to connect and unconnect said bulbs with said battery receptacle for operation of said bulbs and lighting of said eyes; and, bulb mounting means associated with each of said eyes and said bulbs and having securing means associated with said eyes and said bulbs and operable to fixedly mount said bulbs to said eyes limiting removal of said bulbs except by removal of said bulbs with said eyes secured thereto, said bulb mounting means includes a pair of configurations forming said sockets with said configurations removably mounted to said head, said bulb mounting means also includes portions of said eye sockets forming external openings which are restricted limiting movement of said eyes therethrough and with said securing means preventing removal of said bulbs in a direction extending externally from said sockets, said bulbs have ends opposite of said external openings with terminal means extending outwardly therefrom attached to said circuit means, said bulb mounting means further includes a pair of housings removably mounted in said configurations with each housing having mounted therein one of said eyes with bulb, said circuit means includes separate wires connected to each terminal means.

8. The stuffed toy of claim 7 and further comprising:

a door movably mounted to said head to allow access to said configurations and removal and reinsertion of said eyes with bulbs;

a wig removably mounted to said head concealing said door; and, synthetic fastening means mounted to said head and to said wig operable to removably mount said wig to said head.

* * * * *